US008887359B2

(12) United States Patent
Shigematsu et al.

(10) Patent No.: US 8,887,359 B2
(45) Date of Patent: Nov. 18, 2014

(54) APPARATUS FOR MANUFACTURING OPENING MATTER OF LONG-SIZED FIBER TOW

(71) Applicant: Daicel Corporation, Osaka (JP)

(72) Inventors: Masato Shigematsu, Himeji (JP); Toshiyuki Morioka, Himeji (JP)

(73) Assignee: Daicel Corporation, Osaka-Shi (JP)

( * ) Notice: Subject to any disclaimer, the term of this patent is extended or adjusted under 35 U.S.C. 154(b) by 0 days.

(21) Appl. No.: 14/112,200

(22) PCT Filed: Nov. 28, 2012

(86) PCT No.: PCT/JP2012/080793

§ 371 (c)(1),
(2), (4) Date: Oct. 16, 2013

(87) PCT Pub. No.: WO2013/081024

PCT Pub. Date: Jun. 6, 2013

(65) Prior Publication Data

US 2014/0041172 A1 Feb. 13, 2014

(30) Foreign Application Priority Data

Nov. 29, 2011 (JP) ..... 2011-260310

(51) Int. Cl.
*D02J 1/18* (2006.01)
*D01D 11/02* (2006.01)
*D02J 1/02* (2006.01)

(52) U.S. Cl.
CPC ..... *D02J 1/02* (2013.01); *D02J 1/18* (2013.01)
USPC ..... 28/283; 28/220

(58) Field of Classification Search
CPC ..... D02J 1/08; D02J 1/12; D02J 1/18; D02J 1/02; D01D 10/0481
USPC ..... 28/283, 282, 273, 271, 278, 281, 220; 19/66 T, 65 T; 493/44, 46, 50
See application file for complete search history.

(56) References Cited

U.S. PATENT DOCUMENTS

| | | | | |
|---|---|---|---|---|
| 2,966,198 | A * | 12/1960 | Wylde | 156/180 |
| 3,099,594 | A | 7/1963 | Caines et al. | |
| 3,262,181 | A | 7/1966 | Hawkins et al. | |
| 3,282,768 | A | 11/1966 | Gaines et al. | |
| 3,297,506 | A | 1/1967 | Pannill, Jr. et al. | |
| 3,714,686 | A * | 2/1973 | Schmid et al. | 28/255 |

(Continued)

FOREIGN PATENT DOCUMENTS

| | | | |
|---|---|---|---|
| JP | 59-500422 | A | 3/1984 |
| JP | 61-7824 | B2 | 3/1986 |

(Continued)

*Primary Examiner* — Amy Vanatta
(74) *Attorney, Agent, or Firm* — Birch, Stewart, Kolasch & Birch, LLP

(57) ABSTRACT

[Means for Solution] A preliminary opening unit 1, an opening unit 2 and a swelling/shaping unit 3 are connected so as to form a communicated space for delivering a fiber tow 10 continuously. A fiber tow 10 is contacted with a particulate additive in a nozzle 32 of the opening unit (2), is opened in an opening zones Z1 and Z2, is swollen and shaped in the swelling/shaping unit 3 for obtaining a long-sized opening matter in which the fiber tow opening matter and the particulate additive are integrated.

20 Claims, 6 Drawing Sheets

(56) References Cited

U.S. PATENT DOCUMENTS

| | | | | | |
|---|---|---|---|---|---|
| 4,468,845 | A * | 9/1984 | Harris | 28/283 |
| 4,472,224 | A * | 9/1984 | Pryor | 156/180 |
| 4,476,807 | A * | 10/1984 | Pryor | 118/317 |
| 5,060,351 | A * | 10/1991 | Street | 28/283 |
| 5,282,779 | A * | 2/1994 | Sakai et al. | 493/44 |
| 6,253,431 | B1 | 7/2001 | Ames et al. | |
| 6,983,520 | B2 * | 1/2006 | Ames et al. | 28/282 |
| 2005/0066496 | A1 | 3/2005 | Ames et al. | |
| 2012/0103352 | A1 | 5/2012 | Taniguchi et al. | |

FOREIGN PATENT DOCUMENTS

| | | | |
|---|---|---|---|
| JP | 2004-244794 | A | 9/2004 |
| JP | 2006-102479 | A | 4/2006 |
| JP | 2007-506509 | A | 3/2007 |
| JP | 2008-255529 | A | 10/2008 |
| JP | 2011-241487 | A | 12/2011 |
| JP | 2012-95590 | A | 5/2012 |
| WO | WO 83/03267 | A1 | 9/1983 |

* cited by examiner

APPARATUS FOR MANUFACTURING OPENING MATTER OF LONG-SIZED FIBER TOW

TECHNICAL FIELD

The present invention relates to an apparatus for manufacturing an opening matter of a long-sized fiber tow being suitable as materials for manufacturing a disposable diaper, a tobacco filter and the like, and a method for manufacturing an opening matter of a long-sized fiber tow utilizing the apparatus.

BACKGROUND ART

Cellulose acetate fibers are used as absorbers for hygienic goods such as a disposable diaper and sanitary product other than a tobacco filter material. Crimp is applied to a tow of the cellulose acetate filaments, in order to give a swelling to a thread and to make a spinning work easy.

The crimped filaments are transported in a state of being packed in a bale form and being degassed and compressed in a cubical packing container.

In addition, at the time of manufacturing of a final product, after taking out filaments from the bale, the filaments are opened and then molded into a desired shape.

In Patent Document 1 (JP-B 61-7824), the absorber for hygienic goods, made of cellulose acetate fibers is disclosed.

In the above-mentioned Patent Document 1, it is described that one obtained by opening a tow of crimped long-sized fibers of cellulose acetate or one obtained by making short fibers into web has a relatively large water absorption and retention capacity.

In Patent Document 2 (U.S. Pat. No. 3,282,768) and Patent Document 3 (U.S. Pat. No. 3,099,594), there is described an opening method by using air-jet in order to reduce and prevent the damage which is given to a tow by the conventional machine opening.

Furthermore, in Patent Document 4 (U.S. Pat. No. 3,297,506), there is proposed an air opening apparatus which can solve the problems of Patent Documents 2 and 3.

In Patent Document 5 (JP-A 59-500422), there is disclosed an invention where opening is done in a sheet shape by using air opening.

In Patent Document 6 (JP-A 2004-244794), there is disclosed a method for making an absorbent composite by spreading a crimped tow in the direction perpendicular to the direction of tow movement, de-registering the crimped tow, shaping the de-registered tow to a substantially rectangular cross-section, and dispersing a particulate onto the entire shaped tow.

In Patent Document 6, there is further described, in preparation of a diaper which contains a high water-absorbable resin (super absorbent polymer) (super-absorbable polymer in Patent Document 2) (SAP), the SAP powder or slurry is distributed downward to the air-opened tow in the vertical direction, and then is fed to rollers.

In Patent Document 7 (U.S. Pat. No. 3,262,181), there is disclosed a process including introducing the crimped tow into a processing zone in a substantially unidirectional path, directing, in substantially the same direction as the movement to the tow, a first stream of motivating gas, downstream from the introduction of the first motivating gas directing a separate stream of motivating gas against the tow also substantially in the direction of movement of the tow, and, by the separate stream, opening the previously crimped filaments of the tow and, furthermore, performing compression into a unitary rod-like structure.

In Patent Document 8 (JP-A 2008-255529), there are disclosed a fibrous sheet excellent in absorbability over liquids such as water, and a method and an apparatus for manufacturing the fibrous sheet simply.

In each of the above-mentioned prior art documents, the water-absorbent resin (SAP) is added to the fibrous sheet after opening a tow. The reason is because it has been considered conventionally that since a tow bundle in a state where opening has not yet finished is not bulky, the SPA cannot enter the tow bundle even when scattering an additive.

For this reason, as is mentioned in the above-mentioned prior art documents in which the SAP is added to the fibrous sheet after opening a tow, the SAP is mostly unevenly distributed on one surface (upper surface) in the thickness direction of the tow, and there arises a problem when used as an absorber.

Fall-off of the SAP may arise after the subsequent processing.

Although a solution of the problem resulting from the uneven distribution of such SAP is also examined, and for example, the method for obtaining an thin absorbent having a low basis weight is disclosed in Patent Document 9 (JP-A 2006-102479), the method is very complicated.

When employing an opening matter of a tow as manufacture materials of absorbers for hygienic goods such as a disposable diaper, a wide-shaped material is easily processed.

However, according to the prior arts, it is difficult to manufacture a wide-shaped material being suitable for the above-mentioned uses, and when a wide-shaped tow opening matter is forcibly manufactured, it is considered that the following new problems are caused.

When a wide-shaped tow opening matter is manufactured from a tow having the same mass, a density of the tow opening matter becomes small. For this reason, when the SAP is sprayed to the tow opening matter by utilizing pneumatic pressure, there is a possibility that a problem of blowing off of the SAP through the spaces may be caused without holding SAP by a tow opening matter.

Instead of the above-mentioned opening, although a wide-shaped material can be obtained by collapsing the obtained tow opening matter having a circular cross-sectional shape with molding rollers or the like, in such a case, there are problems in which there is only obtained a material in which a thickness is large and a density is large in the center portion, and a thickness is small and a density is small in the both side portions, and thus the absorption performance is deteriorated easily.

PRIOR ART DOCUMENT

Patent Documents

Patent Document 1: JP-B 61-7824
Patent Document 2: U.S. Pat. No. 3,282,768
Patent Document 3: U.S. Pat. No. 3,099,594
Patent Document 4: U.S. Pat. No. 3,297,506
Patent Document 5: JP-A 59-500422
Patent Document 6: JP-A 2004-244794
Patent Document 7: U.S. Pat. No. 3,262,181
Patent Document 8: JP-A 2008-255529
Patent Document 9: JP-A 2006-102479

DISCLOSURE OF THE INVENTION

Problems to be Solved by the Invention

An object of the present invention is to provide a manufacturing apparatus for obtaining a wide opening matter having a wider width which is suitable as a material for manufacturing absorbers for hygienic goods such as a tobacco filter and a disposable diaper, which can increase an amount of particulate additives contained in the opening matter of a fiber tow compared with prior arts, and which can enhance a retention capacity of the above-mentioned particulate additives.

Furthermore, another object of the present invention is to provide a manufacturing method of the opening matter by using the above-mentioned manufacturing apparatus.

Means for Solving the Problems

The invention of claim 1 according to the present application is, as the means to solve the problems, a manufacturing apparatus for manufacturing an opening matter of long-sized fiber tow, and provides a manufacturing apparatus including a preliminary opening unit (1) having at least one pair of rolls, an opening unit (2) connected to the preliminary opening unit (1), and a swelling/shaping unit (3) connected to the preliminary opening unit (1); the preliminary opening unit (1), the opening unit (2) and the swelling/shaping unit (3) being connected so as to form a communicated space for delivering a fiber tow (10) continuously; the opening unit (2) including an adding part (20) of particulate additives, and an opening part (30) connected to the adding part (20); the opening part (30) including a cylindrical body part (31) being opened to both ends, where an opening on one end side (the adding part (20) side) being connected to an adding part body (21), and an opening part (31*b*) at the other end being connected to the swelling/shaping unit (3), a nozzle part (32) having nozzles (35), inside the adding part (20) of the body part (31), which are arranged at regular intervals with an inner peripheral surface of the body part (31), and a gas supplying pore (36) which is provided so as to communicate the inside and outside of the body part (31) and which is opened to face a gap between the nozzle part (32) and the body part (31); the body part (31) including a first opening zone (Z1) which the nozzles (35) of the nozzle part (32) face, and a second opening zone (Z2) from the first opening zone (Z1) to the opening part (31*b*); an inner diameter (d1) of at least the first opening zone (Z1) being uniform; the swelling/shaping unit (3) being connected to the opening part (31*b*) of the body part (31) via an adapter (50), and including the adapter (50) and an elastic body which is fixed to the adapter and which is for regulating a shape of a swelling fiber tow from outside; and the adapter (50) including, in its inside, an inclined surface which is enlarged toward an exit (51).

In addition, the invention of claim 8 according to the present application is, as the means to solve the problems, a manufacturing method of the opening matter of the long-sized fiber tow by using the above-mentioned manufacturing apparatus, and an object of the invention is to provide a manufacturing method of the opening matter of the long-sized fiber tow including the steps of: preliminarily opening a crimped fiber tow while passing through the crimped fiber tow continuously; contacting the preliminarily opened fiber tow with particulate additives; opening, by an air stream, the fiber tow which is contacted with the particulate additives; and swelling and shaping the opened fiber tow.

Effect of the Invention

By manufacturing through the use of the manufacturing apparatus of the present invention, an opening matter of a long-sized fiber tow which contains a larger amount of particulate additives relative to the mass of the fiber tow can be obtained than the case of applying the prior arts.

MODES FOR CARRYING OUT THE INVENTION

First Embodiment

There will be explained the embodiment of the manufacturing apparatus shown in FIG. 1 and the manufacturing method by using the apparatus.

Figure 1:
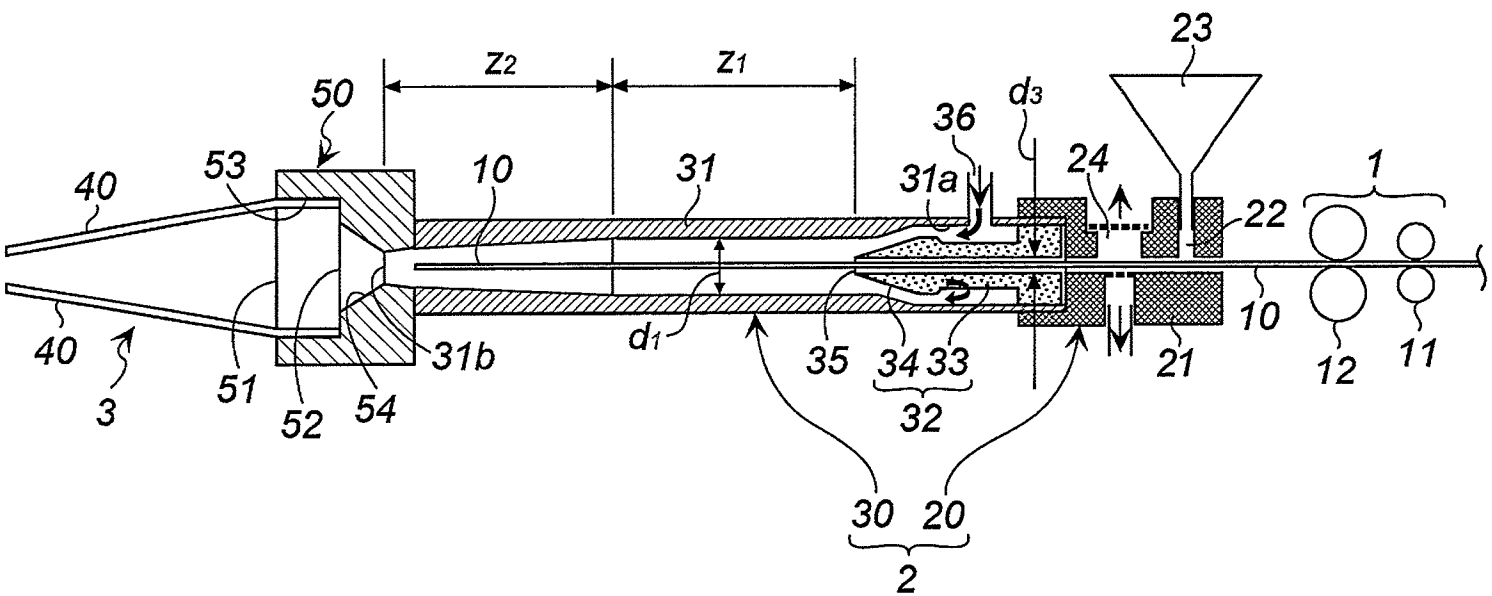
FIG. 1 An axial cross-sectional view showing the side surface of the manufacturing apparatus of the present invention.

Although the apparatus shown in FIG. 1 has the same basic structure as the manufacturing apparatus shown in FIG. 1 of JP 2008-255529 A, some preferable modifications are partially carried out in order to implement the manufacturing method of the present invention.

The details of the above-mentioned modifications will be mentioned later. However, in JP 2008-255529 A, opening of a fiber is not described at all after the addition of particulate additives to a fiber tow.

The manufacturing apparatus shown in FIG. 1 has a preliminary opening unit 1, an opening unit 2 connected to the preliminary opening unit 1, and a swelling/shaping unit 3 connected to the preliminary opening unit 1 (the same as the reservoir described in the paragraphs 56 to 62 of JP-A 2008-255529).

The preliminary opening unit 1, the opening unit 2 and the swelling/shaping unit 3 are connected so as to form a communicated space for delivering a fiber tow 10 continuously.

Hereinafter, the preliminary opening unit 1 side is referred to as the upstream side, and the swelling unit 3 side is referred to as the downstream side, for explanation.

(1) Preliminary Opening Process in the Preliminary Opening Unit 1

In the preliminary opening unit 1, preliminary opening is carried out by passing the crimped fiber tow 10 continuously which is taken out from the fiber tow bale through between one pair of the roll 11 and one pair of rolls 12.

When not holding the fiber tow 10 between one pair of rolls, the fiber tow 10 cannot obtain sufficient tension in the opening unit 2.

A roll ratio of the roll 11 to the roll 12 may be, for example, 1 to 3, preferably 1.1 to 2.5, further preferably 1.2 to 2.

The preliminary opening unit 1 and the preliminary opening process are the same as those described in the paragraphs 45 to 46 of JP-A 2008-255529.

Note that the preliminary opening process may be any method if the fiber tow 10 can be pinched and the movement of the fiber tow 10 can be controlled, and, for example, may be a method of having a structure of being strongly pressed to a narrow slit part by air pressure.

As the fiber tow 10, there can be used those described at paragraphs [0042] to [0044] in JP-A 2008-255529. Specific examples can include cellulose ester-based fibers (e.g. cellulose acetate-based fibers such as cellulose monoacetate, cellulose diacetate, cellulose triacetate or cellulose acetate propionate), polyester-based fibers, polyamide-based fibers, acrylate-based fibers, olefin-based fibers, polyvinyl alcohol-based fibers, and the like. The fibers may be a monofilament, or a composite fiber, or a mixed fiber.

In particular, cellulose acetate-based fibers are preferable.

(2) In the opening unit 2 (adding part 20), after performing the process in which the preliminary opened fiber tow is contacted with the particulate additive, while delivering continuously the preliminary opened fiber tow 10 to the adding part 20 of the opening unit 2, the particulate additive is contacted therewith.

The adding part 20 is not illustrated in the apparatus shown in FIG. 1 of JP-A 2008-255529, and is the specific part of the apparatus according to the present invention. Note that the adding part 20 is a preferable element in implementing the manufacturing method of the present invention, but is not essential.

First, the adding part 20 of the opening unit 2 will be explained.

The adding part 20 includes an adding part body 21 where a through-hole having a width being necessary to deliver the fiber tow 10 is formed in the axial direction.

The adding part body 21 has an adding pore 22 formed, for the particulate additive formed in the vertical direction, and a hopper 23 is connected to the adding pore 22. The adding pore 22 is communicated with the through-hole formed in the adding part body 21 for delivering the fiber tow 10.

The adding part body 21 is separated into two parts in the longitudinal direction as shown in FIG. 1, and the separated parts serve as a vent 24 for discharging air. The vent 24 may be the same as a well-known vent hole (for example, one currently installed in a well-known extrusion machine for resin molding, or the like).

Next, the adding method of the particulate additive by using the adding part 20 of the opening unit 2 will be explained.

By adding the particulate additive from the hopper 23 and the adding hole 22 during passing through the adding part 20, the preliminary opened fiber tow 10 is contact with the particulate additive. At the time of adding the particulate additive, since the additive is not in contact with an air stream (opening air stream) for opening as is used in prior arts, the particulate additive is not dispersed.

The particulate additive is selected depending on the use (performance to be possessed) of the opening matter of the fiber tow 10 obtained finally, and is not particularly limited. As the particulate additive, there can be used a water absorbable resin or water soluble resin for water absorbing purpose, and a resin, active carbon and the like for deodorization purpose.

A range of particle size of the particulate additive is determined depending on the use.

An addition amount of the particulate additive relative to the mass (100 parts by mass) of the fiber tow 10 is preferably 100 to 800 parts by mass, more preferably 200 to 600 parts by mass, and further preferably 250 to 450 parts by mass.

According to the manufacturing method using the manufacturing apparatus of the present invention, it is easy to make the particulate additive hold to the opening matter of the fiber tow 10, and thus particulate additives larger than the mass of the fiber tow can be added and held.

(3) the Opening Process for Opening the Fiber Tow which has been Contacted with the Particulate Additive by Air Stream in the Opening Unit 2 (Opening Part 30)

Next, in the opening process, the fiber tow 10 which has been contacted with the particulate additive is opened by air stream.

First, the structure of the opening part 30 of the opening unit 2 will be explained.

In the opening part 30, there is formed a shell by a cylindrical body part 31 in which both ends are opened, an opening on one end side (the adding part 20 side) is connected to an adding part body 21, and an opening part 31*b* at the other end is connected to the swelling/shaping unit 3.

The nozzle part 32 is arranged inside the body part 31 on the adding part 20 side. The nozzle part 32 has a shank 33 and an arrowhead part 34, and has the nozzle (slit shaped nozzle) 35 which passes throughout them and opens at the tip of the arrowhead part 34.

In the body part 31, there is formed a gas supplying pore 36 which is communicated with its inside. The gas supplying pore 36 is arranged at directly opposite to the shank 33 of the nozzle part 32.

The shank 33 and the arrowhead part 34 of the nozzle part 32 are arranged at regular intervals with an inner peripheral surface 31*a* of the body part 31.

When the above-mentioned interval is smaller, an air suction pressure from the air supplying pore 36 becomes larger relatively (an amount of air to be suctioned becoming smaller), and thus the impelling force of the fiber tow 10 is enhanced, and when the above-mentioned interval is larger, an air suction pressure from the air supplying pore 36 becomes smaller relatively (an amount of air to be suctioned becoming larger), and it also generates a factor where the particulate additive is reversely injected into the air supplying pore 36 side and scatters.

For this reason, the smaller the width of the above-mentioned interval is preferable, but when the width is too small, productivity is lowered, and thus the width of the above-mentioned interval is preferably in the range of 0.3 to 1.0 mm.

In the body part 31, the inner diameter of the portion where the nozzle part 32 is arranged is large, and the inner diameter (d1) of the subsequent first opening zone (Z1) is relatively small, and the inner diameter (d1) of the body part 31 is uniform except that the inner diameter at a second opening zone (Z2) reduces as it extends towards the opening part 31*b*. The nozzle 35 faces the first opening zone (Z1).

The cross-section in the width direction of the body part 31 forming the first opening zone (Z1) is circular.

The second opening zone (Z2) designates a range from the boundary between the first opening zone (Z1) and the second opening zone (Z2) to the opening part 31*b* of the swelling/shaping unit 3 side.

The cross-section in the width direction of the body part 31 forming the second opening zone (Z2) is circular.

The nozzle diameter (d3) of the nozzle 35 is adjusted depending on the retention form and the retention amount (content) of the particulate additive in the opening matter of the intended long-sized fiber tow 10. That is, the retention form and the retention amount (content) of absorbents in the opening matter of the fiber tow 10 can be controlled by adjustment of the nozzle diameter (d3) of the nozzle 35.

The nozzle diameter (d3) of the nozzle 35 is preferably in the range of 5 to 30 mm, more preferably in the range of 5 to 25 mm.

The size of the inner diameter (d1) of the first opening zone (Z1) can be set to about 3 to 10 times the nozzle diameter (d3) of the nozzle 35. In addition, from a viewpoint of productivity, when the total denier of the fiber tow 10 is 35000, the size of the inner diameter (d1) of the first opening zone (Z1) is preferably 20 mm, and can be increased and decreased in proportion to the numerical value of the total denier.

Next, the opening method in the opening part 30 will be explained.

The fiber tow 10 in contact with the particulate additive in the adding part 20 passes through the inside of the nozzle part 32, and then is discharged from the nozzle 35 to the first opening zone Z1 in the body part 31.

In this stage, a state is reached in which the particulate additive exists in a part (portion directly opposite to the adding pore 22) of the partially opened fiber tow 10, and the gas stream (air stream) supplied into the body part 31 from the gas supplying pore 36 is contacted. Since the gas supplying pore 36 is arranged directly opposite to the shank 33 of the nozzle part 32, at the time of air supply, the air does not collide with the cellulose fiber tow 10 directly.

Since, when a pneumatic pressure supplied from the gas supplying pore 36 is too high, a retention time in the following swelling/shaping process may become short, and swelling may become insufficient. Therefore, preferable range is 0.3 MPa or less, and more preferable range is 0.01 to 0.3 MPa.

In order to obtain an opening matter of skin/core structure, preferable range is 0.01 to 0.1 MPa, and more preferable range is 0.05 to 0.1 MPa.

In order to obtain an opening matter of uniform dispersion structure, preferable range is 0.1 to 0.3 MPa, and more preferable range is 0.1 to 0.2 MPa.

The air supplied from the gas supplying pore 36 forms the flow moving in the swelling unit 3 (opening part 31*b*) direction, and, in such a state, makes contact with the cellulose fiber tow 10 which is discharged from the nozzle 35 in the first opening zone Z1. Thereafter, the cellulose fiber tow 10 is swollen by pneumatic pressure in the thickness direction and then opened.

Note that in the above-mentioned process, due to the air stream, a pressure difference is generated between the rear part of the nozzle part 32 and the tip part (the first opening zone Z1) of the nozzle part 32, and the pressure at the tip part of the nozzle part 32 becomes higher.

As is in such a state, the added particulate additive scatters from the back end of the nozzle part 32, which makes it difficult to increase the addition amount. However, by providing the above-mentioned vent 24, and by exhaustion of the air therefrom to make the pressure normal, the scattering of the particulate additive is prevented, and thus it becomes possible to increase the addition amount of the particulate additive.

(4) the Opening Process of Swelling and Shaping the Opened Fiber Tow

The fiber tow 10 which is opened in the opening process (the opening unit 2) and retains the particulate additive is delivered to the swelling/shaping unit 3, and then is shaped while being swollen.

First, the structure of the swelling/shaping unit 3 will be explained.

The swelling/shaping unit 3 is connected to the opening part 31*b* of the body part 31 via an adapter 50, and includes the adapter 50 and an elastic body (flat spring) 40 which is fixed to the adapter and is for regulating a shape of a swelled fiber tow from outside.

Figure 3:
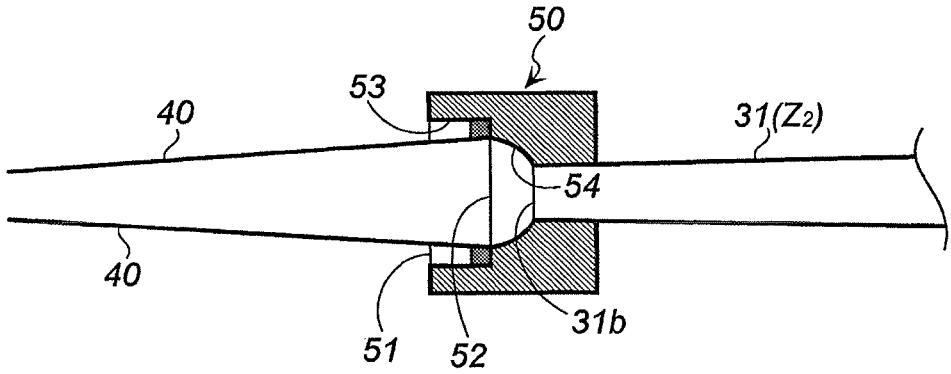
FIG. 3 A partial cross-sectional view of an embodiment different from FIG. 1.

The adapter 50 includes an inclined surface 54 which is enlarged from the opening part 31*b* toward an exit 51. The enlarged inclined surface 54 is conical surface as shown in FIG. 1, 2 or spherical surface as shown in FIG. 3. In the adapter 50, preferably the inner diameter of the opening part 52 is 25 to 50 mm, the inner diameter of the opening part 31*b* is 15 to 40 mm, and the length of the inclined surface 54 is 5 to 30 mm, more preferably 10 to 25 mm.

By providing such an inclined surface 54, when the opened tow enters the adapter 50 from the second opening zone Z2, the gap between the opening matter and the inclined surface 54 is put into a state of being closed by spreading the opening matter of the tow along the inclined surface 54.

For this reason, the air stream containing the particulate additive becomes hard to be discharged through the gap between the opening matter and the inner surface of the adapter 50, and the amount of scattering of the particulate additive from the opening matter (fall-off amount) is decreased in comparison with conventional apparatuses.

Figure 6:
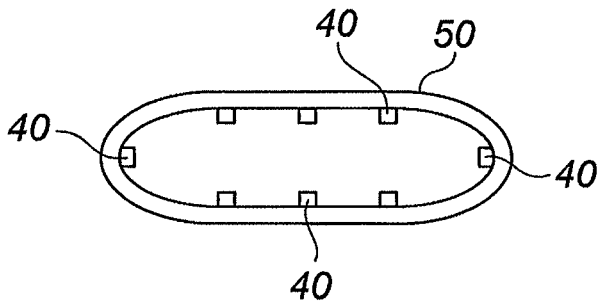
FIG. 6 A front view of a swelling/shaping unit of the apparatus of FIG. 1.

The cross-sectional shape in the width direction of the adapter 50 is a flat shape, and the exit 51 is an oval shape which satisfies a ratio of longer axis length/shorter axis length being between 2 and 10 as shown in FIG. 6. The ratio of the longer axis length/shorter axis length is preferably between 3 and 8, more preferably between 4 and 7.

The exit 51 of the adapter 50 may have any shape which satisfies the above-mentioned relation, and preferably, the exit has a shape selected from: in addition to an elliptical shape, a rhombus and a shape in which the corners thereof which are directly opposite are arc, a rectangle, a shape in which the corners of the rectangle are arc, and a shape in which the sides of the rectangle which are directly opposite are arc.

In FIG. 1, a plurality of the flat springs 40 is fixed to the inner wall surface 53 of the adapter 50 so as to be arranged at regular intervals in the peripheral direction, and in side view, is attached to the adapter 50 so as to have a tapered shape.

The flat springs 40 can also be attached to the outer wall surface of the adapter 50.

Figure 5:
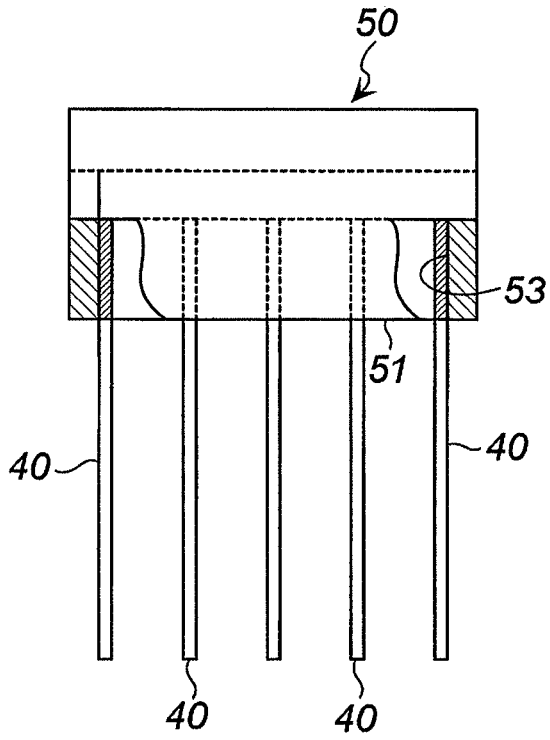
FIG. 5 A plan view of a swelling/shaping unit of the apparatus of FIG. 1 (including a cross cross-sectional view in part).

As shown in FIG. 5 and FIG. 6, a plurality of sheets of the flat springs 40 is combined and arranged so as to have a cylindrical shape as a whole, and the neighboring flat springs 40 are arranged at intervals. The part in which the flat spring 40 does not exist serves as a gap for exhausting air.

By attaching the plurality of the flat springs 40, when the opened tow which is extruded from the second opening zone Z2 swells, shaping mechanism may work by circumferentially pressing by a plurality of the flat spring 40, and thus the shaping can be smoothly performed.

Note that, although not shown, there can be arranged a core rod for holding the swollen opening matter (for preventing the swollen opening matter from hanging down).

By setting the exit 51 of the adapter 50 to be of the longer axis length/shorter axis length of between 2 and 10, as mentioned above, an opening matter having broader shape than conventional one can be obtained.

Figure 2:
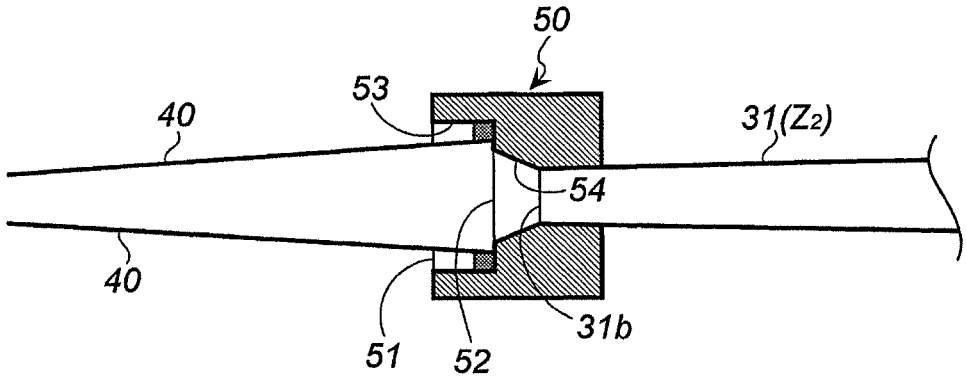
FIG. 2 A partial cross-sectional view of the apparatus of FIG. 1.
Figure 11:
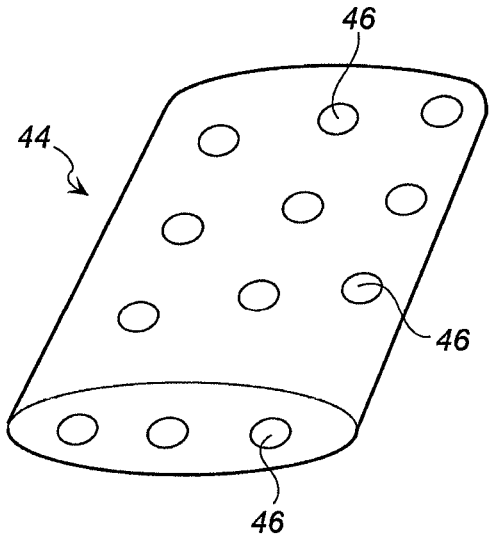
FIG. 11 A perspective view of a swelling/shaping unit of another embodiment.

As the swelling unit 3, there can be used, in addition to one shown in FIG. 2, a cylinder 44 which is made of flexible metal and has many air exhausting pores 46 in its peripheral surface, as shown in FIG. 11.

The inner diameter of the swelling/shaping unit 3 is set to be substantially larger than the outer diameter of the body part 31, and is preferably one or more times the outer diameter of the body part 31, more preferably one to 1.4 times.

The length (the length of the flat spring 40) of the swelling/shaping unit 3 can be, for example, within the range of 150 to 350 mm.

The cross-sectional shape and width of the finally obtained opening matter can be adjusted depending on the shape (cross-sectional shape of the exit 51 in the width direction) of the swelling/shaping unit 3.

Next, the swelling/shaping method in the swelling/shaping unit 3 will be explained.

The fiber tow 10 which retains the particulate additive and is opened in the opening process is discharged from the opening part 31*b* of the body part to the swelling/shaping unit 3 having a larger diameter.

In this process, as described above, the amount of scattering of the particulate additive from the opening matter (scattering from the exit of an adding device) decreases by the action of the inclined surface 54 of the adapter 50.

Then, although the opened fiber tow 10 swells to a broad shape according to the shape of the exit 51 of the adapter 50, excessive swelling is inhibited by the action of the elasticity of the flat spring 40.

In the swelling and shaping process, after the opening matter of the fiber tow 10 retains temporarily and is then extruded, the particulate additive is held in the opening matter of the fiber tow 10 without scattering due to the retention.

After the swelling/shaping process, the tow opening matter is extruded continuously from the swelling/shaping unit 3, there is obtained the long-sized tow opening matter (swollen body of the tow opening matter) in which the particulate additive is held.

The swollen body of the tow opening matter obtained according to the manufacturing method using the manufacturing apparatus of the present invention has an increased retention amount by the decrease of a fall-off amount of the particulate additive.

Furthermore, the swollen body of the tow opening matter obtained according to the manufacturing method using the manufacturing apparatus of the present invention has a small fall-off amount of the particulate additive, and a distribution of the particulate additive becomes more uniform.

The long-sized fiber tow opening matter (swollen body of the fiber tow opening matter) obtained by using the manufacturing apparatus of the present invention can provide a fiber tow opening matter (swollen body of the fiber tow opening matter) having a desired structure by adjusting a nozzle diameter (d3).

(Opening Matter of Skin/Core Structure)

The long-sized fiber tow opening matter (swollen body of the fiber tow opening matter) having a skin/core structure has a structure composed of a thick skin layer almost constituted by only a tow, and the highly concentrated particulate additive being present in the center portion (core) in the axial direction.

When obtaining the material of this skin/core structure, the diameter (d3) of the nozzle 35 is preferably in the range of from 5 mm to less than 12 mm, more preferably in the range of 6 to 10 mm.

In the embodiment in which the nozzle diameter (d3) is in the above-mentioned range, the moving speed of the fiber tow 10 is different from that of the particulate additive at the exit of the nozzle 35, and thus the fiber tow 10 has a tendency to move forward while spreading, but the particulate additive is blown away by opening air as it is, and moves forward.

Figure 12:
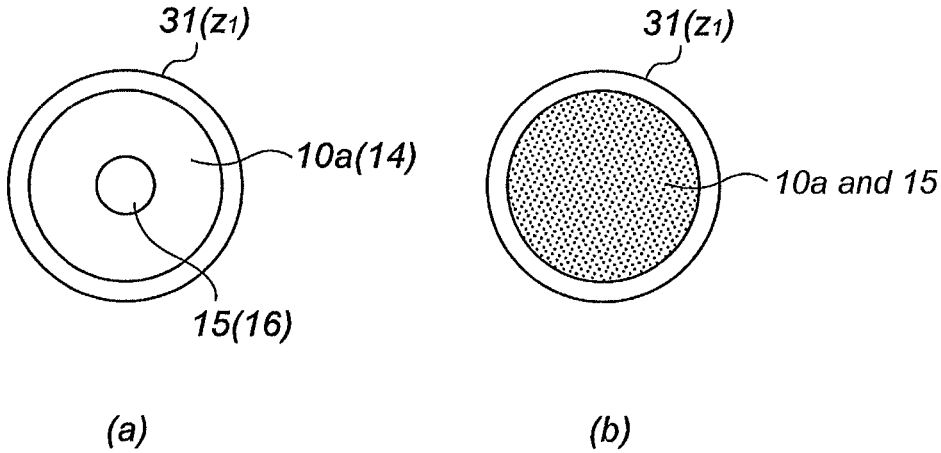
FIG. 12 A drawing showing a cross-sectional structure of the opening matter obtained at a process in the middle of the manufacturing method in which the manufacturing apparatus of the present invention is used.

For this reason, in the first opening zone (Z1), as shown in FIG. 12(*a*), there is obtained the opening matter having the skin/core structure having the skin layer 14 composed of the tow opening matter 10*a* and the core 16 composed of the particulate additive 15 concentrated in the center portion in the axial direction.

In case of using the fiber tow 10 and the particulate additive in the range of the above-mentioned ratio, when the outer diameter of the finally obtained opening matter is 150 mm, the opening matter of the skin/core structure has a thickness of the skin layer of approximately 2 to 10 mm.

Meanwhile, FIG. 12(*a*) shows the positional relationship of the skin layer 14 and the core 16, and the actually manufactured one does not form the clear boundary between the skin layer 14 and the core 16 as shown in FIG. 12(*a*), but there is the core 16 in which, in the center portion in the axial direction, majority of the particulate additive 15 is concentrated, and a part of the particulate additive 15 is dispersed also in the skin layer 14 around the core 16.

When applying the manufacturing method by using the manufacturing apparatus of the present invention, the amount of the particulate additive existing in the core of the opening matter can be 95% by mass or more in the total amount, preferably 97% by mass or more, more preferably 99% by mass or more.

Note that the opening matter of the skin/core structure shown in FIG. 12(*a*) is obtained in the form of being applied to an absorber by compression in the thickness direction with rolls or the like.

(Uniform Dispersion Structure)

The long-sized fiber tow opening matter (swollen body of the fiber tow opening matter) having uniform dispersion structure has a mode in which the particulate additive is distributed uniformly with respect to the entire fiber tow (however, one that is in a state where apart is caused to adhere on the surface).

In order to obtain a material having this uniform dispersion structure, the diameter (d3) of the nozzle 35 is preferably in the range of 12 to 30 mm, more preferably in the range of 12 to 25 mm.

According to the embodiment in which the nozzle diameter (d3) is in the above-mentioned range, there may be provided a mode in which the particulate additive is more widely dispersed in comparison with an embodiment in which the nozzle diameter (d3) is relatively small.

In such a distribution mode, as shown in FIG. 12(*b*), there is provided an opening matter having a structure in which the particulate additive 15 is uniformly distributed in the tow opening matter 10*a* in the first opening zone (Z1).

In the long-sized fiber tow opening matter of the uniform dispersion structure, the particulate additive adhering on the surface may fall off in the swelling/forming process, and in the subsequent processes of performing processing into a shape suitable for the intended use, and thus the content of the particulate additive becomes smaller in comparison with the opening matter of the skin/core structure.

Note that the opening matter of the uniform dispersion structure shown in FIG. 12(*b*) is finally obtained in the form applied to an absorber by compression in the thickness direction, with rolls or the like.

Second Embodiment

The manufacturing apparatus shown in FIG. 7 and FIG. 8 and an embodiment of the manufacturing method using it will be explained.

Figure 7:
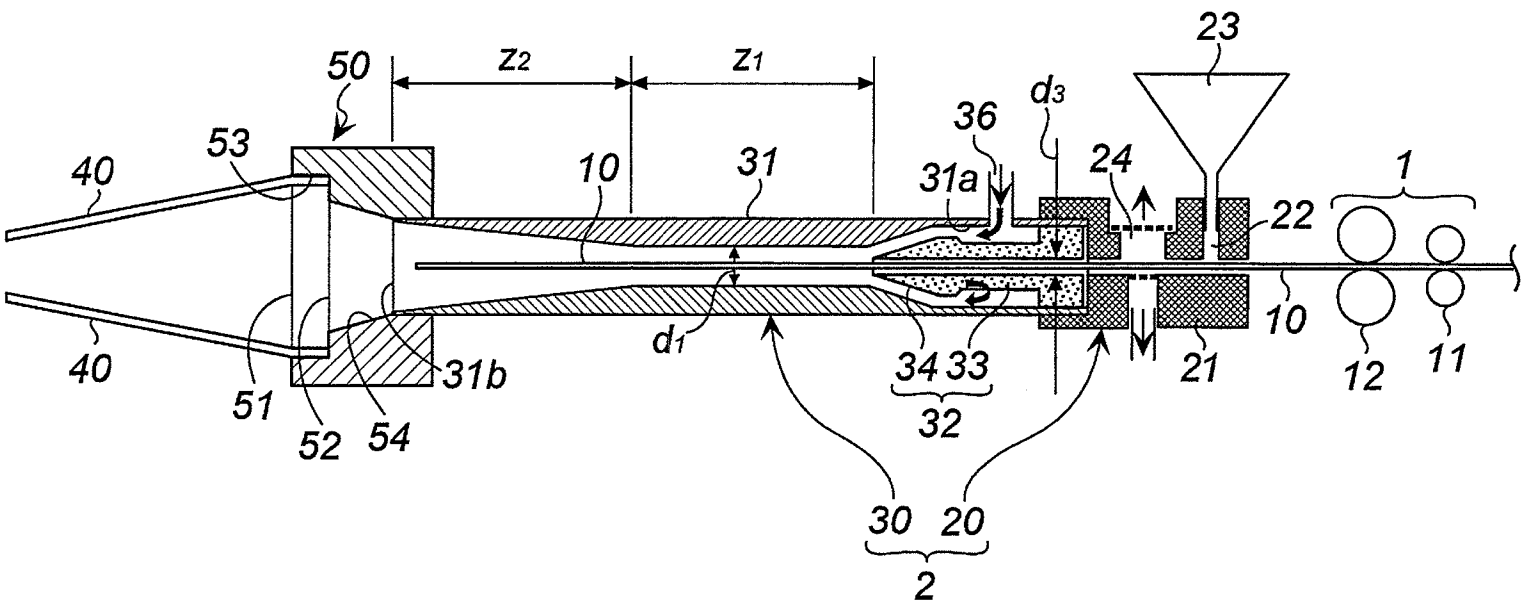
FIG. 7 An axial cross-sectional view showing the side surface of another embodiment of the manufacturing apparatus of the present invention.
Figure 8:
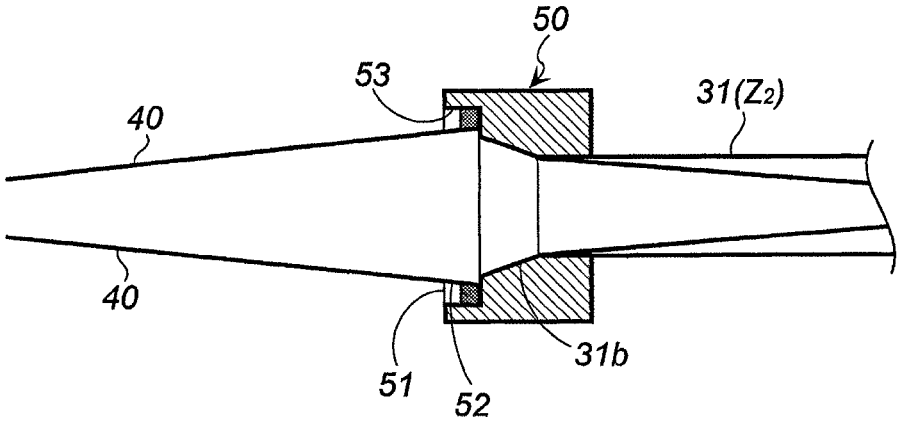
FIG. 8 A partial cross-sectional view of the apparatus of FIG. 7.

The manufacturing apparatus shown in FIG. 7 and FIG. 8 is the same as the manufacturing apparatus shown in FIG. 1, in the preliminary opening unit 1, the opening unit 2 (adding part 20), and the first opening zone (Z1) of the opening unit 2 (opening part 30), and the structures in the downstream therefrom are different.

Therefore, hereinafter, only the different structure parts will be explained.

The cross-sectional shape in the width direction of the second opening zone Z2 formed in the body part 31 is circular, but the inner diameter becomes large little by little from the boundary between the first opening zone Z1 and the second opening zone Z2, toward the opening 31*b*.

The swelling/shaping unit 3 is connected to the opening part 31*b* of the body part 31 via an adapter 50, and includes the adapter 50 and an elastic body (flat spring) 40 which is fixed to the adapter and is for regulating a shape of a swelling fiber tow from outside.

The adapter 50 includes an inclined surface 54 which is enlarged from the opening part 31*b* to an exit 51. The enlarged inclined surface 54 may have a conical surface as shown in FIG. 7, 8 or may have a spherical surface as shown in FIG. 3.

In the adapter 50, preferably the inner diameter of the opening part 52 is 25 to 50 mm, the inner diameter of the opening part 31*b* is 15 to 40 mm, and the length of the inclined surface 54 is 5 to 30 mm, more preferably 10 to 25 mm.

By providing such an inclined surface 54, when the opened tow enters the adapter 50 from the second opening zone Z2, the gap between the opening matter and the inclined surface 54 is put into a state of being closed by spreading the opening matter of the tow along-sized along the inclined surface 54. For this reason, the air stream containing the particulate additive becomes hard to be discharged through the gap between the opening matter and the inner surface of the adapter 50, and the amount of scattering of the particulate additive from the opening matter (fall-off amount) is decreased in comparison with conventional apparatuses.

Figure 10:
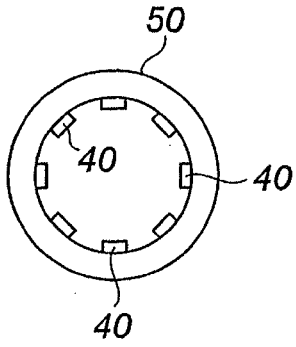
FIG. 10 A front view of a swelling/shaping unit of the apparatus of FIG. 7.

The cross-sectional shape in the width direction of the adapter 50 is circular, and the exit 51 is circular as shown in FIG. 10.

In FIGS. 7 and 8, a plurality of the flat springs 40 is fixed to the inner wall surface 53 of the adapter 50 so as to be arranged at regular intervals in the peripheral direction, and in side view, is attached to the adapter 50 so as to have a tapered shape.

The flat springs 40 can also be attached to the outer wall surface of the adapter 50.

As shown in FIG. 10, a plurality of sheets of the flat springs 40 is combined and arranged so as to have a cylindrical shape as a whole, and the neighboring flat springs 40 are arranged at intervals.

The part in which the flat spring 40 does not exist serves as a gap for exhausting air.

By attaching the plurality of the flat springs 40, when the opened tow which is extruded from the second opening zone Z2 swells, shaping mechanism may work by circumferentially pressing by a plurality of the flat spring 40, and thus the shaping can be smoothly performed.

Note that, although not shown, there can be arranged a core rod for holding the swollen opening matter (for preventing the swollen opening matter from hanging down).

As the swelling unit 3, there can be used, in addition to one shown in FIGS. 7, 8, a cylinder 44 which is made of flexible metal and has many air exhausting pores 46 in its peripheral surface, as shown in FIG. 11.

The inner diameter of the swelling/shaping unit 3 (inner diameter of the exit) is set to be substantially larger than the outer diameter of the body part 31, and is preferably one or more times the outer diameter of the body part 31, more preferably one to 1.4 times.

The length (the length of the flat spring 40) of the swelling/shaping unit 3 can be, for example, within the range of 150 to 350 mm.

The cross-sectional shape and width of the finally obtained opening matter can be adjusted depending on the shape (cross-sectional shape in the width direction) of the swelling/shaping unit 3.

The opening matter of the fiber tow (swelling body of the fiber tow opening matter) obtained by the manufacturing method of the present invention can contain the particulate additives larger than the mass of the fiber tow.

For this reason, when various products such as a disposable diaper, a sanitary product and a tobacco filter are manufactured by using the above-mentioned fiber tow opening matter, since the amount of scattering (fall-off amount) of the particulate additive (high molecular water absorbing agent, active carbon, etc.) can be decreased in comparison with the case where a prior art is applied, the performance of various products can be enhanced.

Particularly when the fiber tow opening matter of the skin/core structure is applied to a disposable diaper, a sanitary product and the like, since there can be obtained a material in which the particulate additive (high molecular water absorbing agent) is unevenly and locally distributed in a large amount, the performance as a product can be further enhanced.

Moreover, when the opening matter has the skin/core structure, there is an advantage that the particulate high molecular absorbing agent is hard to fall off during the shaping process in which the fiber tow opening matter is made into the desired shape, in comparison with the fiber tow opening matter of the uniform dispersion structure.

In addition, when shaping into the tobacco filter, since it is possible to make the particulate additive absent on the surface, mouth-feeling at the time of smoking is good.

EXAMPLE

Examples 1 and 2, Comparative Example 1

The manufacturing apparatus shown in Table 1 was used.

The FIG. 1 and FIG. 2 mean the use of one shown in FIG. 2 as the swelling and shaping unit in the manufacturing apparatus of FIG. 1.

The FIG. 1 and FIG. 3 mean the use of one shown in FIG. 3 as the swelling and shaping unit in the manufacturing apparatus of FIG. 1.

Figure 4:
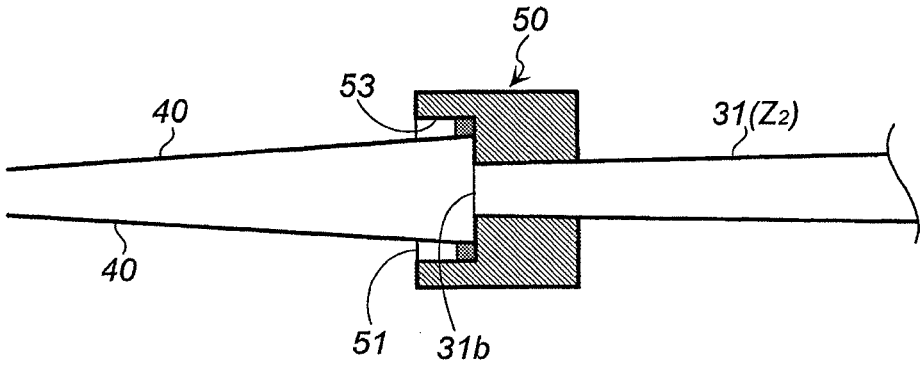
FIG. 4 A partial cross-sectional view of a comparative example of the apparatus of FIG. 1.

The FIG. 1 and FIG. 4 mean the use of one shown in FIG. 4 as the swelling and shaping unit in the manufacturing apparatus of FIG. 1.

FIG. 4 is one in which the inclined surface 54 shown in FIGS. 1, 2 is absent.

An opening matter of a cellulose fiber tow was manufactured through the use of each of the manufacturing apparatuses shown in Table 1.

In any of examples, 12 sheets of the flat spring (1.2 mm in thickness, 6 mm in width, and 150 mm in length) in total were used for the swelling/shaping unit 3.

As the particulate additive, polyacrylate was used as high molecular water absorbing agent particles (SAP).

As the polyacrylate, the high molecular absorbing agent was collected by disassembling a commercially available disposable diaper (UNICHARM CORPORATION, MUNI MAN SLIM PANTS). This high molecular absorbing agent was used at a rate of 10 g/3 g tow.

In order to make the observation easy, the particles of this high molecular absorbing agent were previously colored with an oil red marker. The addition amount of high molecular water absorption agent particles (SAP) was changed as shown in Table 1.

Note that, for example, SAP/fiber=2/1 means the addition of the SAP twice the amount relative to 1 mass of fiber.

The width of the fiber tow 10 after the preliminary opening was 100 mm, and the operating speed (feed rate of the fiber tow 10) was adjusted in the range of 50 m/min.

The air pressure from the air supplying pore 36 was set to 0.05 MP.

(1) Width of Opening Matter

The opening matter was cut, 10 points were measured in the width direction, and an average value was obtained.

(2) Degree of Entanglement of Fibers

The evaluation was conducted by the sense of touch. ○ is the case where the opening matter has flexibility.

x is the case of no flexibility. The middle sense of touch is evaluated as Δ.

(3) SAP Dispersibility

The dispersibility of the SAP was observed with naked eyes. ○ is the case where the red color is dispersed uniformly, x is the case where the red color is biased.

(4) SAP Scattering Rate

The opening apparatus was operated for 10 minutes, and the fall-off amount of SAP during the operation was recovered by using a tray which was installed under the adapter 50, and an amount of the fall-off amount of SAP per 10 minutes was measured. A theoretical addition amount of SAP to the opening matter was obtained from the addition amount of the SAP, and then a scattering rate (%) of the SAP was obtained in accordance with the following equation.

$$\text{Scattering rate (\%)} = \text{SAP fall-off amount (g)}/(\text{theoretical SAP addition amount (g)}) \times 100$$

TABLE 1

| | | Example 1 | Example 2 | Comparative Example 2 |
|---|---|---|---|---|
| Manufacturing apparatus | | FIG. 1/ FIG. 2 | FIG. 1/FIG. 3 | FIG. 1/FIG. 4 |
| Inclined surface 54 | Shape | Conical | Spherical | — |
| | Length (mm) | 14 | 14 | — |
| Exit 51 | Shape | Oval | Oval | Oval |
| | Longer axis/ shorter axis | 82.4/24.0 | 82.4/24.0 | 82.4/24.0 |
| Width of opened material (mm) | | 100 | 100 | 90-100 |
| Degree of entanglement of fibers | | ○ | ○ | Δ-X |

TABLE 1-continued

| | | Example 1 | Example 2 | Comparative Example 2 |
|---|---|---|---|---|
| Dispersibility of SAP | | ○ | ○ | Δ-X |
| Scattering rate of SAP (%) | SAP/Fiber = 2/1 | 0.1 | 0.1 | 0.2 |
| | SAP/Fiber = 3/1 | 0.3 | 0.4 | 1.9 |
| | SAP/Fiber = 4/1 | 0.7 | 0.9 | 3.5 |

By using the manufacturing apparatus shown in FIG. 1/FIG. 2, or FIG. 1/FIG. 3, it was recognized that the scattering rate of the SAP was able to be lowered.

Example 3, Comparative Example 2

The manufacturing apparatus shown in Table 2 was used.

The FIG. 7 and FIG. 8 mean the use of one shown in FIG. 8 as the swelling and shaping unit in the manufacturing apparatus of FIG. 7.

Figure 9:
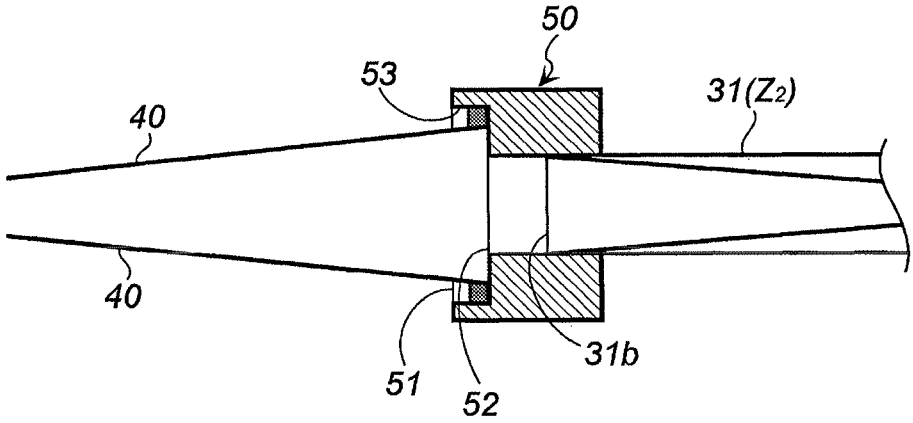
FIG. 9 A partial cross-sectional view of a comparative example of the apparatus of FIG. 7.

The FIG. 7 and FIG. 9 mean the use of one shown in FIG. 9 as the swelling and shaping unit in the manufacturing apparatus of FIG. 7.

FIG. 9 is one in which the inclined surface 54 shown in FIG. 7 and FIG. 8 is absent.

By using each of the manufacturing apparatus shown in Table 2, the opening matters of the cellulose fiber tow were manufactured in the same manner as in Examples 1 and 2 and Comparative example 1.

TABLE 2

| | | Example 1 | Comparative Example 2 |
|---|---|---|---|
| Manufacturing apparatus | | FIG. 7/FIG. 8 | FIG. 7/FIG. 9 |
| Inclined surface 54 | Shape | Conical | — |
| | Length (mm) | 24 | — |
| Exit 51 | Shape | Spherical | Spherical |
| Width of opening material (mm) | | 75 | 75 |
| Scattering rate (%) | SAP/Fiber = 2/1 | 0 | 0.1 |
| | SAP/Fiber = 3/1 | 0 | 2.0 |
| | SAP/Fiber = 4/1 | 0 | 3.1 |

By using the manufacturing apparatus shown in FIG. 7 and FIG. 8, it was confirmed that he scattering rate of the SAP was able to be extremely lowered.

INDUSTRIAL APPLICABILITY

The opening matter of the fiber tow obtained by using the manufacturing apparatus of the present invention is suitable as a material for manufacturing a tobacco filter, and a material for a disposable diaper, a sanitary product and the like.

DESCRIPTION OF REFERENCE NUMERALS

1 Preliminary opening unit
2 Opening unit
3 Swelling/shaping unit
10 Fiber tow
20 Adding part of particulate additive
21 Adding part body
22 Adding pore
24 Vent
30 Opening part
31 Body part
32 Nozzle part

35 Nozzle
36 Air supplying pore
40 Flat spring
50 Adapter
51 Exit of adapter
54 Inclined surface of adapter

The invention claimed is:

1. A manufacturing apparatus for manufacturing an opening matter of long-sized fiber tow, the manufacturing apparatus comprising:

a preliminary opening unit having at least one pair of rolls, an opening unit connected to the preliminary opening unit, and a swelling and shaping unit connected to the preliminary opening unit;

the preliminary opening unit, the opening unit and the swelling and shaping unit being connected so as to form a communicated space for delivering a fiber tow continuously;

the opening unit including:

an adding part of particulate additives, and an opening part connected to the adding part;

the opening part including a cylindrical body part being opened to both ends, where an opening on a first end being connected to an adding part body, and a second end, opposite to the first end, being connected to the swelling and shaping unit, a nozzle part having nozzles, inside the adding part of the body part, which are arranged at regular intervals with an inner peripheral surface of the body part, and a gas supplying pore which is provided so as to communicate with the inside and outside of the body part and which is opened to face a gap between the nozzle part and the body part;

the body part including a first opening zone which the nozzles of the nozzle part face, and a second opening zone extending from the first opening zone to the second end;

an inner diameter of at least the first opening zone being uniform;

the swelling and shaping unit being connected to the second end of the body part via an adapter, and including the adapter and an elastic body which is fixed to the adapter and which is for regulating a shape of a swelling fiber tow from outside; and the adapter including, in its inside, an inclined surface which is enlarged toward an exit.

2. The manufacturing apparatus according to claim 1, wherein the inclined surface which is enlarged toward an exit inside the adapter has a conical surface or a spherical surface.

3. The manufacturing apparatus according to claim 1, wherein an inner diameter of the second opening zone is reduced from the first opening zone toward the second end.

4. The manufacturing apparatus according to claim 1, wherein cross-sectional shapes in the width direction of the first opening zone and the second opening zone are circular, and a cross-sectional shape in the width direction of the exit of the adapter satisfies a ratio of the longer axis length/shorter axis length being between 2 and 10.

5. The manufacturing apparatus according to claim 1, wherein a cross-sectional shape in the width direction of the first opening zone is circular, a cross-sectional shape in the width direction of the second end of the second opening zone satisfies a ratio of the longer axis length/shorter axis length being between 2 and 10, and a cross-sectional shape in the width direction of the exit of the adapter satisfies a ratio of the longer axis length/shorter axis length being between 2 and 10.

6. The manufacturing apparatus according to claim 4, wherein the shape which satisfies the ratio of the longer axis length/shorter axis length being between 2 and 10 includes one of is an oval, a rhombus, a rhombus with rounded opposing corners, a rectangle with rounded corners, and a rectangle with arcuate opposing sides.

7. The manufacturing apparatus according to claim 1, wherein the adding part includes an adding part body having a through-hole for delivering the fiber tow in the axial direction, an adding pore for the particulate additive which is formed in the adding part body and further communicated with the through-hole, and a vent.

8. The manufacturing apparatus according to claim 2, wherein the body part comprising a first opening zone which the nozzles of the nozzle part face, and a second opening zone from the first opening zone to the second end; an inner diameter of at least the first opening zone is uniform; an inner diameter of the second opening zone is reduced from the first opening zone toward the second end.

9. The manufacturing apparatus according to claim 2, wherein cross-sectional shapes in the width direction of the first opening zone and the second opening zone are circular, and a cross-sectional shape in the width direction of the exit of the adapter satisfies a ratio of the longer axis length/shorter axis length being between 2 and 10.

10. The manufacturing apparatus according to claim 3, wherein cross-sectional shapes in the width direction of the first opening zone and the second opening zone are circular, and a cross-sectional shape in the width direction of the exit of the adapter satisfies a ratio of the longer axis length/shorter axis length being between 2 and 10.

11. The manufacturing apparatus according to claim 2, wherein a cross-sectional shape in the width direction of the first opening zone is circular, a cross-sectional shape in the width direction of the second end of the second opening zone satisfies a ratio of the longer axis length/shorter axis length being between 2 and 10, and a cross-sectional shape in the width direction of the exit of the adapter satisfies a ratio of the longer axis length/shorter axis length being between 2 and 10.

12. The manufacturing apparatus according to claim 3, wherein a cross-sectional shape in the width direction of the first opening zone is circular, a cross-sectional shape in the width direction of the second end of the second opening zone satisfies a ratio of the longer axis length/shorter axis length being between 2 and 10, and a cross-sectional shape in the width direction of the exit of the adapter satisfies a ratio of the longer axis length/shorter axis length being between 2 and 10.

13. The manufacturing apparatus according to claim 5, wherein the shape which satisfies the ratio of the longer axis length/shorter axis length being between 2 and 10 is a shape selected from: in addition to an oval, a rhombus and a shape in which the corners thereof which are directly opposite are arc, a rectangle, a shape in which the corners of the rectangle are arc, and a shape in which the sides of the rectangle which are directly opposite are arc.

14. The manufacturing apparatus according to claim 2, wherein the adding part includes an adding part body having a through-hole for delivering the fiber tow in the axial direction, an adding pore for the particulate additive which is formed in the adding part body and further communicated with the through-hole, and a vent.

15. The manufacturing apparatus according to claim 3, wherein the adding part includes an adding part body having a through-hole for delivering the fiber tow in the axial direction, an adding pore for the particulate additive which is formed in the adding part body and further communicated with the through-hole, and a vent.

16. The manufacturing apparatus according to claim 4, wherein the adding part includes an adding part body having a through-hole for delivering the fiber tow in the axial direction, an adding pore for the particulate additive which is formed in the adding part body and further communicated with the through-hole, and a vent.

17. The manufacturing apparatus according to claim 5, wherein the adding part includes an adding part body having a through-hole for delivering the fiber tow in the axial direction, an adding pore for the particulate additive which is formed in the adding part body and further communicated with the through-hole, and a vent.

18. The manufacturing apparatus according to claim 6, wherein the adding part includes an adding part body having a through-hole for delivering the fiber tow in the axial direction, an adding pore for the particulate additive which is formed in the adding part body and further communicated with the through-hole, and a vent.

19. A manufacturing method of an opening matter of a long-sized fiber tow by using the manufacturing apparatus according to claim 1, wherein the manufacturing method of an opening matter of a long-sized fiber tow comprising the steps of:

preliminarily opening a crimped fiber tow while passing the crimped fiber tow continuously through the manufacturing apparatus;

contacting the preliminarily opened fiber tow with particulate additives;

opening, by an air stream, the fiber tow which is contacted with the particulate additives; and swelling and shaping the opened fiber tow.

20. A manufacturing method of an opening matter of a long-sized fiber tow by using the manufacturing apparatus according to claim 2, wherein the manufacturing method of an opening matter of a long-sized fiber tow comprising the steps of:

preliminarily opening a crimped fiber tow while passing through the manufacturing apparatus continuously;

contacting the preliminarily opened fiber tow with particulate additives;

opening, by an air stream, the fiber tow which is contacted with the particulate additives; and swelling and shaping the opened fiber tow.

* * * * *